United States Patent [19]

Cole

[11] 4,030,168

[45] June 21, 1977

[54] METHOD AND APPARATUS FOR TRAVERSING A STRAND TO FORM A RESTRAINED WEB

[75] Inventor: Paul Morrison Cole, Wilmington, Del.

[73] Assignee: E. I. Du Pont de Nemours and Company, Wilmington, Del.

[22] Filed: Aug. 27, 1976

[21] Appl. No.: 718,338

Related U.S. Application Data

[63] Continuation-in-part of Ser. No. 652,658, Jan. 27, 1976, abandoned.

[52] U.S. Cl. ..... 28/101; 156/439

[51] Int. Cl.[2] ..... D04H 3/04; D04H 3/05

[58] Field of Search ..... 28/1 CL, 72 R, 72 NW; 242/47.12; 156/181, 430, 431, 439, 440, 441; 428/105

[56] References Cited

UNITED STATES PATENTS

| | | | |
|---|---|---|---|
| 3,805,341 | 4/1974 | Jense | 28/1 CL |
| 3,878,591 | 4/1975 | Jense | 28/1 CL |
| 3,921,265 | 11/1975 | Eschenbach | 28/1 CL |
| 3,950,583 | 4/1976 | Patin | 28/1 CL |

*Primary Examiner*—Louis K. Rimrodt

[57] ABSTRACT

A method of traversing a strand between two spaced rows of strand-restraining elements moving together in the same direction in the same plane to form a web is implemented by a pair of strand-engaging members associated with each row of strand-restraining elements for slideably engaging the strand and moving it in alternate traverses toward one and then the other row while forming a loop in the strand during each traverse. The loop is brought into a plane parallel to the plane of the rows of strand-restraining elements and beyond the rows. Means are provided for disengaging the loop from the strand-engaging members and depositing the loop around the strand-restraining elements.

10 Claims, 18 Drawing Figures

METHOD AND APPARATUS FOR TRAVERSING A STRAND TO FORM A RESTRAINED WEB

CROSS REFERENCE TO RELATED APPLICATION

This is a continuation-in-part of my copending application Ser. No. 652,658, filed Jan. 27, 1976 and now abandoned.

BACKGROUND OF THE INVENTION

This invention relates to a method and apparatus for traversing a strand or strands to form a restrained cross-laid web. More particularly, it relates to a method adaptable to forming restrained webs of a wide variety of strand laydown patterns, and to apparatus upon which the method can be carried out at high speed.

A "restrained web" is one in which the strands which comprise the web, after being cross-laid in a given configuration, are held in that configuration by pins or other restraining elements until a desired operation is carried out upon the web. Additional tension may be applied to the restrained web by increasing the distance of the pins across the web after it is laid.

Many types of machines have been developed for withdrawing a strand from a package and traversing it across a moving conveyor to form a web useful for reinforcing paper or other sheet materials, of for forming scrim or other fabrics. The cross-laid web is frequently combined with a warp sheet of strands, and the two sheets may be bonded together with adhesives or otherwise. However, most of the prior art apparatus can be operated only at relatively low speed. Many of these machines are restricted to laydown of a single strand, and others are incapable of forming a restrained web. Most of the prior art machines are restricted to a particular laydown pattern, e.g., a diagonal pattern, which can be varied only to a minor extent such as by changing the spacing of the strands. In particular, the achievement of a truly orthogonal laydown has been a problem in the prior art. This is important, since for many products it is desired to have reinforcing strands across the width of the product at right angles to the long or machine direction of the product.

Though the term "strand" will be used throughout the specification, this term is meant to include materials such as yarn, threads, cords, filaments and the like. Such strands may be of either natural or synthetic material.

SUMMARY OF THE INVENTION

According to this invention a new method and apparatus have been developed for cross laying or traversing strands at 90° or other angles to the machine direction at relatively high speed. The apparatus is one for traversing a strand between two spaced rows of strand-restraining elements moving together in the same direction at the same speed in the same plane to form a web. The apparatus includes a strand supply source, a guide located out of the plane of the rows of strand-restraining elements but between the rows for receiving the strand from the supply source, and at least one pair of rotatable strand-engaging members associated with each row of strand-restraining elements for slidably engaging the strand between the guide and the plane of the rows and traversing the strand toward one and then the other row while forming a loop in the strand during each traverse. The loop is brought into a plane substantially parallel with the plane of the rows and extended beyond the rows and is then disengaged from the strand-engaging members and deposited about at least one of the strand-restraining elements.

The method involves not only forming a loop in the strand in the plane of traverse but turning the loop out of the plane of traverse into a plane substantially parallel with the plane of the strand-restraining elements and then depositing the loop thus oriented onto at least one of the strand-restraining elements to form a restrained cross-laid web.

BRIEF DESCRIPTION OF THE ILLUSTRATED EMBODIMENTS

DETAILED DESCRIPTION OF THE ILLUSTRATED EMBODIMENTS

Figure 2:
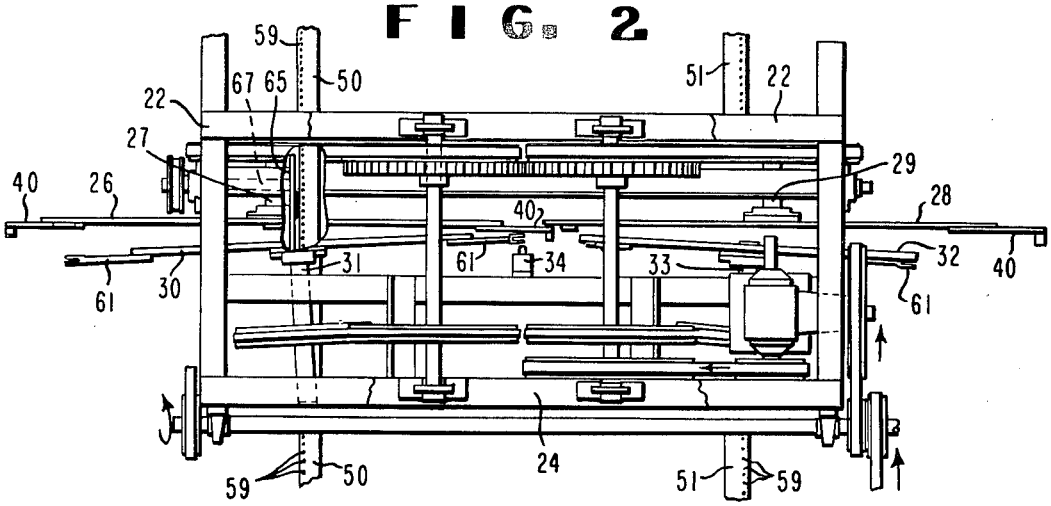
FIG. 2 is a top view of the apparatus shown in FIG. 1.
Figure 1:
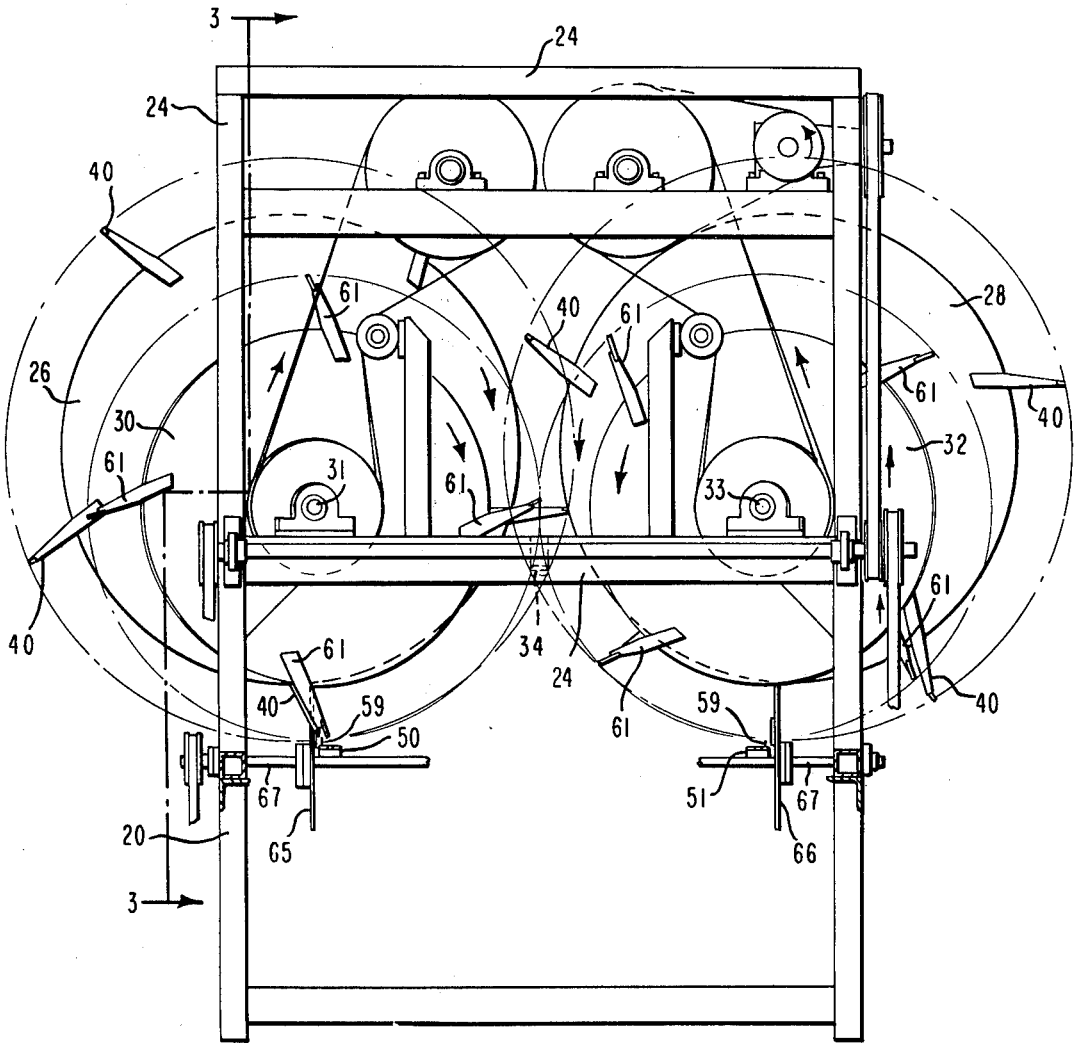
FIG. 1 is a front elevation of the apparatus for traversing strands according to the present invention.
Figure 3:
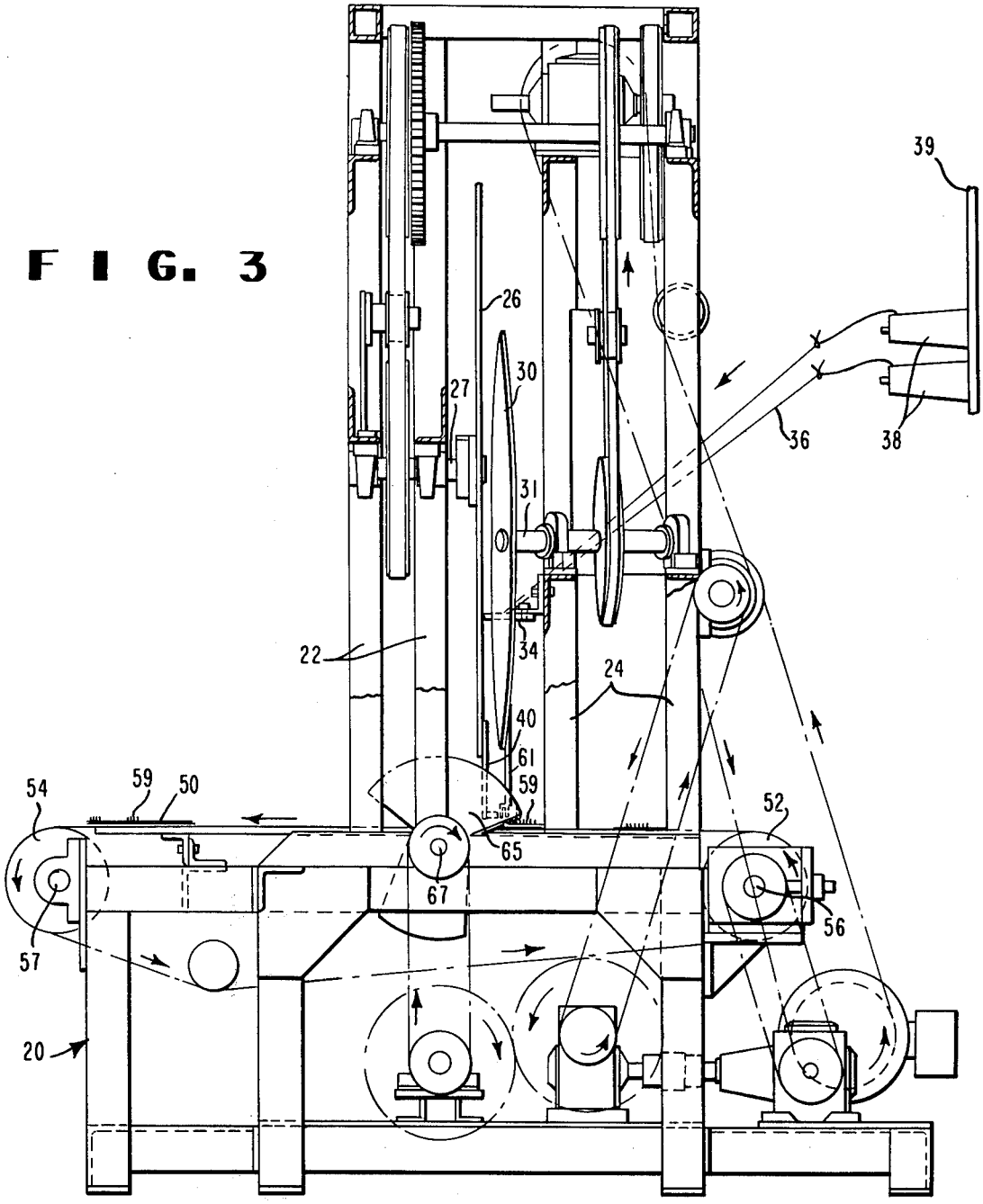
FIG. 3 is a partially sectioned view of the apparatus shown in FIG. 1 taken along 3—3.

Referring to FIGS. 1–3, a suitable framework is indicated comprising bottom frame 20 and two upright frames 22, 24 mounted to the bottom frame. Positively driven primary disks 26 and 28 are mounted on shafts 27 and 29, respectively, for rotation, in the directions shown by the arrows, in bearings mounted on frame 22. In a similar manner positively driven secondary disks 30, 32 are mounted in a skewed relationship to the primary disks on respective shafts 31 and 33 for rotation, in the direction of the arrows, in bearings mounted on frame 24. Positioned midway between disks 26, 28 is a dual-eyelet guide 34 for receiving strands 36 as they come (preferably after passing through a tension gate, not shown) from supply packages 38 mounted on creel 39, which is so positioned that the strands move freely to and through the eyelets of the guide. The eyelets may be provided with slits to facilitate string up.

Primary disks 26, 28 carry yarn hooks 40 attached at five equal spacings on their peripheries and extending outward from these disks. Each of the hooks 40 comprises an arm with an end projecting at right angles to the arm and there are slots formed in this end with the same spacing as the eyelets in guide 34. The plane of disk rotation is such as to align the slots with the eyelets in guide 34. The slots may be formed in a number of ways, e.g., by grooving the projecting end of the arm or by inserting pins therein.

Secondary disks 30, 32 carry spreader arms 61 attached at four equal spacings on their peripheries and extending outward from these disks. The relative speed of rotation of the primary and secondary disks is such that hooks and spreaders always pass by guide 34 in the same position relative to each other. Each spreader arm 61 has fingers extending outward from the arm with spacings between the fingers that match the spacings of the eyelets in guide 34. The path of spreader rotation is such that the fingers just clear guide 34 as they pass by. The interrelationship between the fingers on arms 61, the slots in hooks 40, and the eyelets in guide 34 will be described in more detail later.

Mounted below the disks in frame 20 are a pair of endless driven conveyors 50, 51. The conveyor 50 is mounted on pulleys 52, 54 and conveyor 51 is similarly mounted on pulleys (not shown). Pulley 52 and its counterpart for conveyor 51 are mounted on axle 56 which is mounted for rotation in bearings mounted on one end of the frame 20, and pulley 54 and its counterpart for conveyor 51 are mounted on axle 57 mounted for rotation in bearings mounted at the other end of frame 20. Both conveyors move together at the same rate of speed in the direction of the arrows shown. Mounted on the surface of both conveyors are upstanding pins 59 for restraining the strands. The pins in each row are arranged with the spacing required to obtain the desired web pattern, and the conveyors are moved together in such a way that the proper relationship of pins in each conveyor with respect to the other is maintained.

Doff blades 65, 66 are rotatably mounted on driven shaft 67 in bearings mounted on frame 20. These blades are rotated in vertical planes that are close to but outside the paths of conveyors 50, 51. The blades preferably have notches that match the positions of the slots in hooks 40 as the blades rotate past the hooks. The blades may also have notches that match the positions of the spaces between fingers in spreader arms 61. Synchronization of the blades 65, 66 is such that each blade passes between an arm 61 and conveyor 50 or 51 shortly after arm 61 passes over the conveyor. The blades travel at a higher velocity than the velocity of the arms, the blades preferably being given five to fifteen rotations for each rotation of primary disks 26, 28.

Although all the various motors, pulleys, belts or like mechanical means have not been completely illustrated in the drawings or completely described in the specification for driving or supporting the various rotating disks and conveyors in their desired or required speeds or with the rotation indicated by the direction arrows, it is to be appreciated that such elements and descriptions have been omitted to keep the drawings and the description succinct and to avoid the introduction of matters which are well known expedients in the art. The mechanical driving means and various frames which are used are conventional and merely involve the application of well known mechanical principles.

Figure 4:
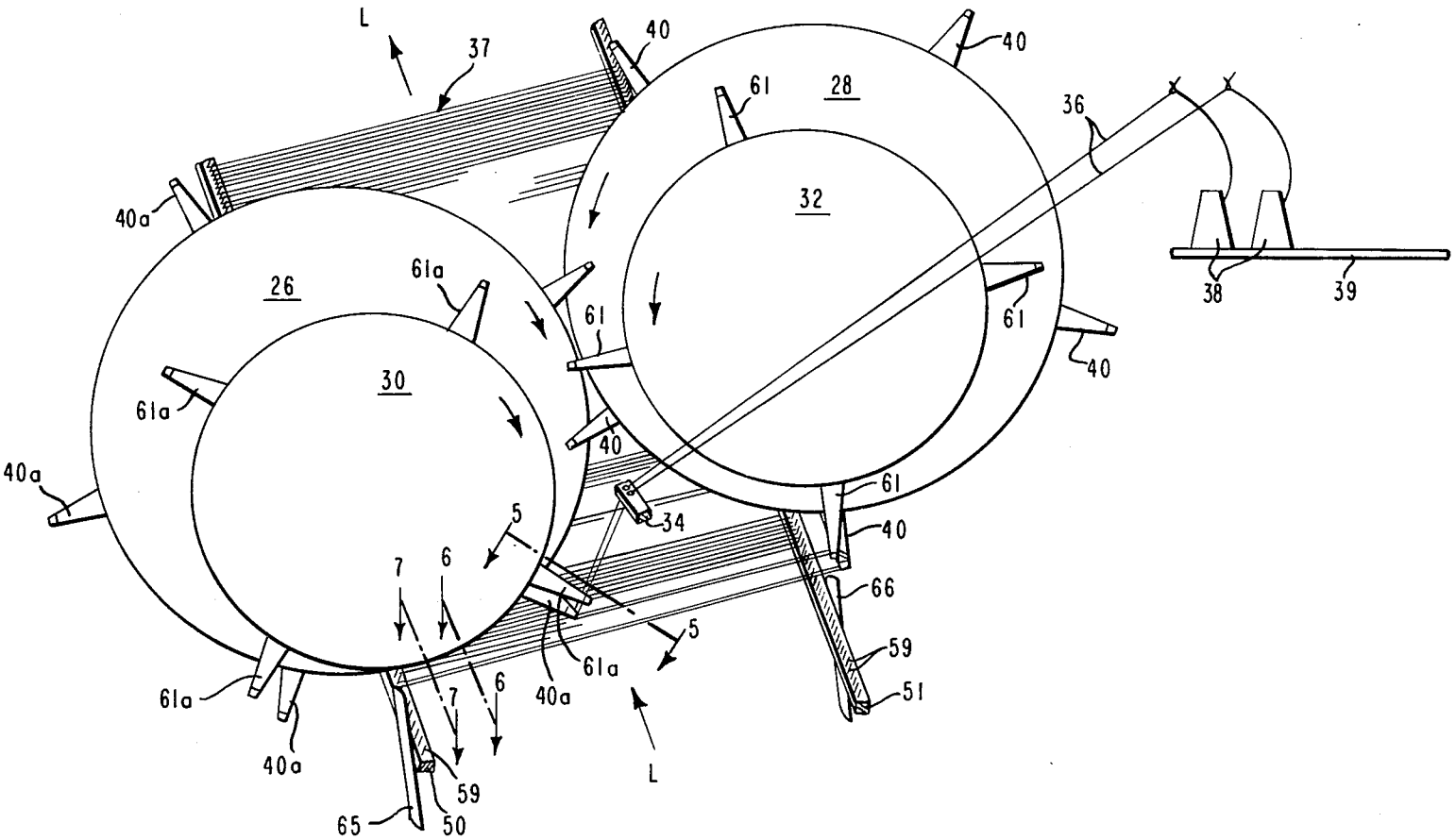
FIG. 4 is a perspective view showing the relationship of hooks and spreaders on the rotating disks for traversing two strands onto the pin conveyor.

Referring now to FIGS. 4–7, the operation of the hooks 40, the spreader arms 61 on the rotating disks along with the endless conveyors 50, 51 and their respective doffing blades 65, 66 provides the means for slideably engaging the strands and traversing them toward one and then the other row of pins 59 on each conveyor. A loop in each strand is formed during each traverse and then the loop is brought into a plane substantially parallel to the plane of the conveyors before being disengaged from the hooks and spreaders and then deposited around pins 59 on the respective conveyors to form an orthogonal web 37 moving in machine direction L. More particularly, FIG. 4 shows two strands 36 being fed from a source of supply to the eyelets of guide 34 located above the plane of the conveyors 50, 51 and each strand is thence led toward and beyond conveyor 51 by the hook 40 on primary disk 28 in a traversing plane which contains its respective eyelet in guide 34 and is transverse to the plane of the conveyors. As the strands are led toward conveyor 51 they are intercepted and slideably engaged by a hook **40*a* on primary disk 26 at a location between conveyor 51 and guide 34 and each strand is thereupon led by a first point of sliding engagement on hook 40*a* through an arc in the traversing plane towards conveyor 50. As the strands are led toward conveyor 50 the fingers of spreader arm 61*a* move down between the strands and across the traversing plane of each strand to intercept each strand in a second point of sliding engagement. This action is caused by mounting the primary and secondary disks so that, in the vicinity of the intersection of the planes of the two disks, the tips of the spreader fingers are farther away from the center of the primary disk than the hooks are. Thus, the strands are led by spreader arm 61*a* still towards conveyor 50 but also away from the traversing plane in a direction opposite the motion of the conveyors through an arc in the skew plane of secondary disk 30**, said skew plane intersecting both the traversing plane and the conveyor plane.

Figure 5:
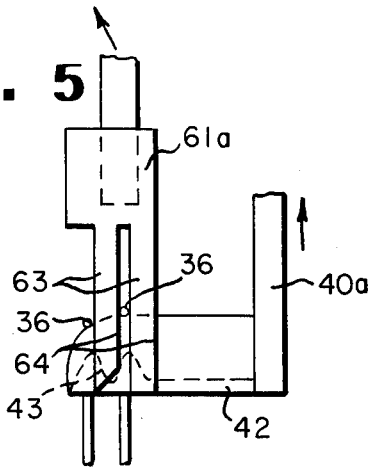
FIG. 5 is a view taken along 5—5 of FIG. 4.
Figure 9:
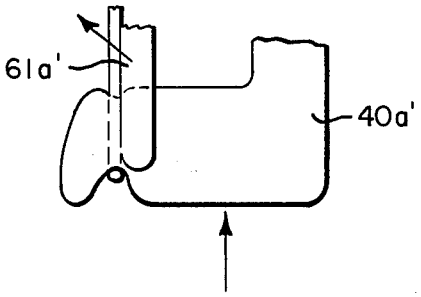
FIG. 9 is a view taken along 9—9 of FIG. 8.
Figure 6:
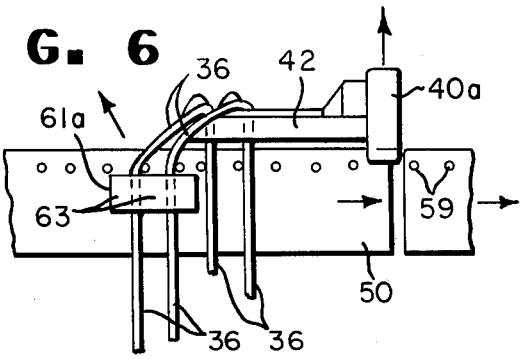
FIG. 6 is a view taken along 6—6 of FIG. 4.

While the strands are being led towards conveyor 50 after being intercepted by hook **40*a* and then spreader arm 61*a*, each strand is formed as an open loop, with one corner of the loop moving in the traversing plane and one corner moving in the skew plane. Each loop is led beyond the conveyor 50 whereupon the strands are intercepted by doff blade 65 slideably engaged around the pins 59 of conveyor 50. To show this clearly, locations 5—5, 6—6 and 7—7 on FIG. 4 are presented as enlarged views (FIGS. 5, 6, 7) of the relationship of the strands, hook and spreader during the traverse through those locations. Referring now to FIG. 5, each hook 40*a* has an end 42 projecting at a right angle and there are slots 43 in the end 42 with the same spacing as the eyelet in guide 34 and each spreader arm 61*a* has at its extreme end fingers 63 which extend outward from the arms and also form spacings 64 which match the spacing of the eyelets in guide 34. The fingers 63 have engaged strands 36 and are leading them towards the conveyor 50 but away from the traversing plane. In FIG. 6, taken at location 6—6 of FIG. 4, the open loops are shown being formed and in FIG. 7 this is shown more clearly wherein the strands 36 have been led by two sliding points of engagement, one on each slot of the hook 40***a* and one on each finger of the spreader arm 61*a* in the form of open loops beyond the conveyor 50. Each loop consists of three sections, a side section 36*a* between the guide 34 and the spreader arm 61*a*, an end section 36*b* between the two sliding points of engagement on the spreader arm and the hook and side section 36*c* between the hook 40*a* and conveyor 51. The loop is moved to the conveyor plane by the action of doff blade 65 so that the side sections 36*a* and 36*c* are deposited in intervals between pins 59 on conveyor 50; the end section 36*b* of the loop bridges a designated number of pins. All of the slideable engaging points holding both loops are disengaged from the strands during the deposition of the loops.

FIGS. 8–11 represent an alternate embodiment with four hooks and spreader arms placed at equal spacing around the periphery of each primary and secondary disk. These disks as with the preferred embodiment are in a skewed relationship with each other, however, companion primary and secondary disks (26′ and 30′; 28′ and 32′) are driven together for traversing a single strand onto the pin conveyors. Similar elements have been given the same numbers only the numbers have been primed.

Conveyors 50′, 51′ comprising two rows of strandrestraining elements (i.e., pins 59′) which are parallel to and spaced apart from one another, defining a conveyor plane, are moved longitudinally in the same direction in the conveyor plane.

A strand 36′ is fed from a source of supply 38′ to a forwarding point (guide 34′) located midway between the two rows and at a distance from the conveyor plane, and the strand is thence led towards one of the rows (conveyor 51′) in a traversing plane which contains the forwarding point and is transverse to the conveyor plane, intercepting both conveyors.

Figure 8:
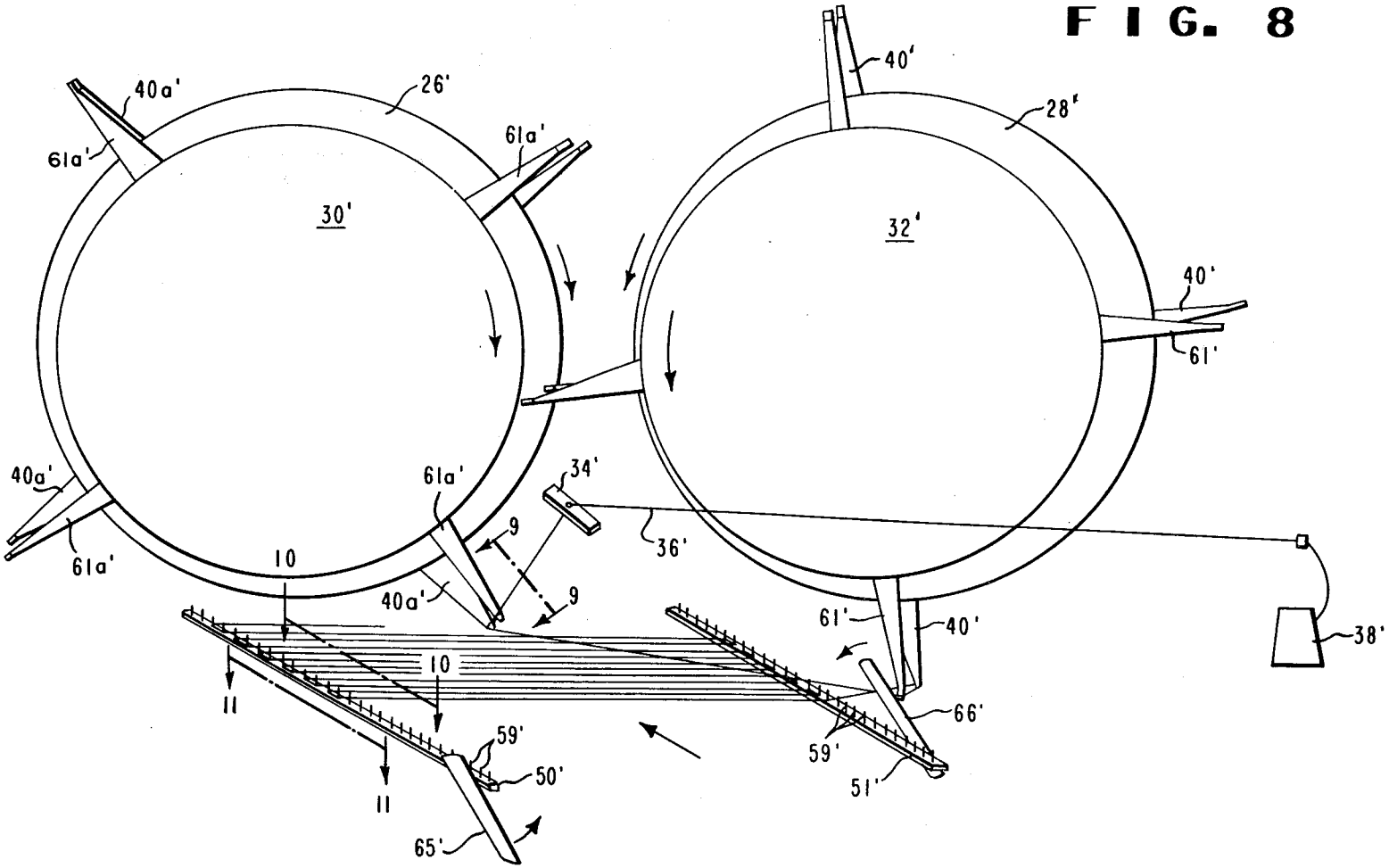
FIG. 8 is a perspective view of another relationship of hooks and spreaders on rotating disks driven together for traversing a single strand onto the pin conveyor.

As the strand is led towards one of the rows (conveyor 51′), it is intercepted and slideably engaged by hook 40*a′* between that row and the guide 34′, and the strand is thereupon led by a first sliding point of engagement on hook 40*a′* through an arc in the traversing plane towards the other row (conveyor 50′, FIG. 8).

Figure 10:
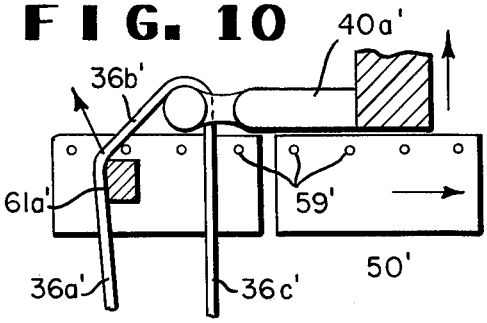
FIG. 10 is a view taken along 10—10 of FIG. 8.
Figure 7:
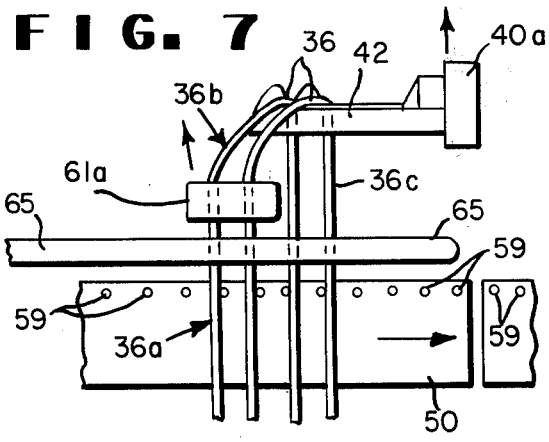
FIG. 7 is a view taken along 7—7 of FIG. 4.
Figure 11:
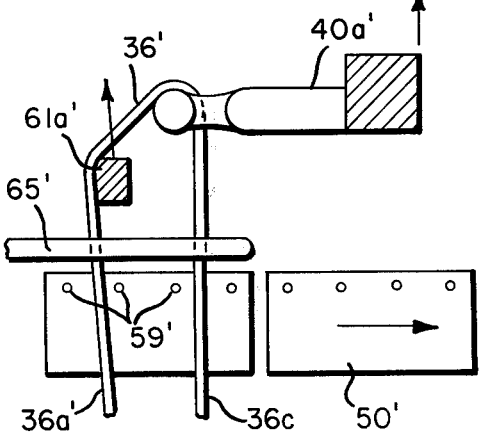
FIG. 11 is a view taken along 11—11 of FIG. 8.

As the strand is led toward conveyor 50′ it is intercepted again between the forwarding point (guide 34′) and the first sliding point of engagement on hook 40*a′* by spreader 61*a′* (FIG. 9) and is then led by a second sliding point of engagement on spreader 61*a′*, still towards the other row but also away from the traversing plane in a direction opposite the direction of motion of the conveyors 50′, 51′, through an arc in a skew plane, said skew plane intersecting both the traversing plane and the conveyor plane (FIG. 10).

While the strand is being led towards the other row (conveyor 50′) after the two interceptions, it is being held in an open loop (hairpin loop) having three sections: a side section 36*a′* between the forwarding point and the second sliding point of engagement, an end section 36*b′* between the two sliding points of engagement, and a side section 36*c′* between the hook 40*a′* and conveyor 51′.

The strand is led by the two sliding points of engagment in the form of the open loop beyond the other row of strand-restraining elements, whereupon the strand is intercepted by doffing blade 65′ (FIG. 11) and slideably engaged upon each side section of the loop at points near the conveyor and moved to the conveyor plane, so that the side sections of the loop are deposited within intervals between the strand-restraining elements, the end section of the loop bridging a designated number of intervals between strand-restraining elements. All of the slideable engaging points are disengaged from the strand during the deposition of the loop.

Figure 12:
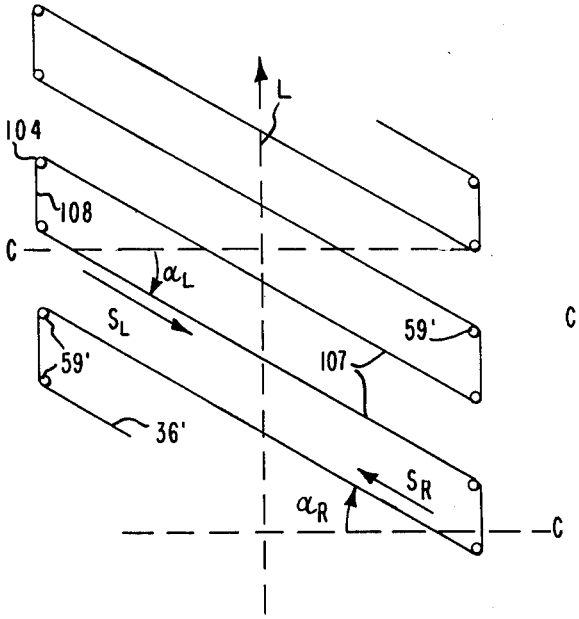
FIG. 12 shows a typical pattern of a single-strand restrained web having parallel, diagonal courses formed by traversing the strand between the rows of strand-restraining pins.

FIG. 12 illustrates a typical web pattern obtained by traversing a single strand 36′ around the pins 59′ in the manner shown in FIG. 8, the completed web moving in the long or machine direction of the web as shown by the arrow L parallel to the center line of each row of pins. The completed web is restrained by the pins, which hold pin-contacting segments of the strand. As shown in more detail in FIG. 14, the pin contacting segments 104 are defined by tangent points 105 at the outermost point of each pin, and 106, on or near the center line of the row of pins. In addition to the pin-contacting segments, the web comprises courses 107 lying between tangent points 106 at opposite sides of the conveyor and selvage segments 108 parallel to web direction L lying outside the rows of pins between tangent points 105. With respect to the cross direction C of the web, normal to L, and with respect to the forward direction of the web, adjacent courses are laid down at angles $\alpha_L$ and $\alpha_R$ from the left and right sides of the conveyor (FIG. 12), respectively. The effective strand direction during the strand laydown is shown by arrow $S_L$ for angle $\alpha_L$ and by arrow $S_R$ for angle $\alpha_R$. In the pattern specifically shown in FIG. 12, each course is laid down parallel to the previously laid down course, so that $\alpha_L = -\alpha_R$. The loop formed in the strand during each traverse as the web is laid down is sufficiently wide to be deposited around two pins at each side of the conveyor, the end of the loop on the supply side of the strand being one end of the next course to be laid down.

Figure 13:
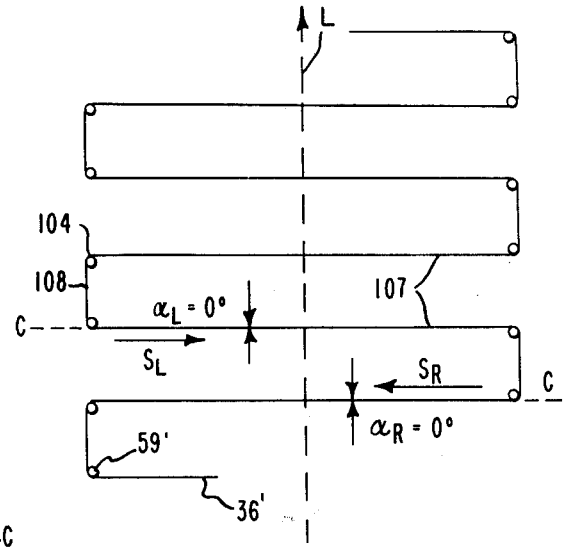
FIG. 13 shows a single-strand restrained web in which all the courses are parallel and orthogonal to the long direction of the web.

FIG. 13 represents the special situation in which $\alpha_L = \alpha_R = 0°$. Each course of the web is orthogonal to the long direction of the web, the strand being laid down at right angles to the direction of the motion of the conveyor. All courses are parallel to one another.

Figure 14:
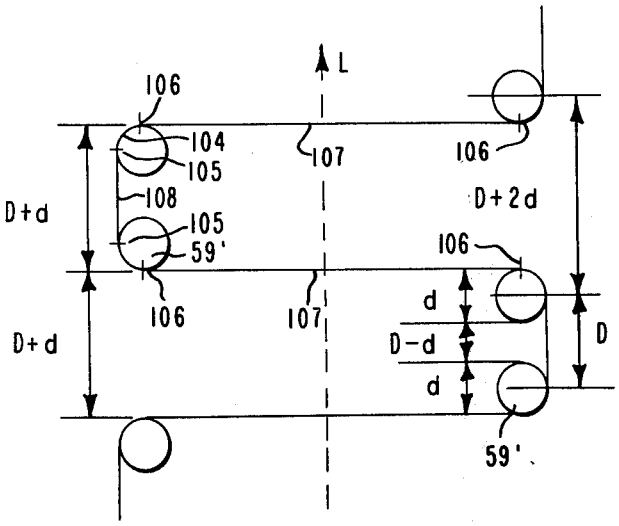
FIG. 14 shows a restrained web like the one in FIG. 13, including details of spacing pins for achieving a pattern in which adjacent courses of the web are truly parallel.

In order for each course of the web to be truly parallel to the preceding course, as in the web patterns of FIGS. 12 and 13, each end of each course (tangent point 106) must be equally spaced in the long direction of the web from each end of the preceding course. A first requirement for achieving such parallelism is a pin arrangement in which the pins on each side of the conveyor are arranged in identical spacing patterns, the pins in each row being positioned for equal spacing of the tangent points 106 at which the courses contact the pins (rather than equal center-to-center spacing of the pins). FIG. 14 shows a suitable pin arrangement for obtaining the web laydown pattern shown in FIG. 13. Each row of pins comprises pairs of pins of diameter d having centers spaced apart by distance D, the center of each pin in each of such pairs being separated in the direction away from the other by a distance $D + 2d$ from the center of the nearest pin of the next pair in the same row. The ends 106 of adjacent courses are thereby equally spaced from one another on each side in the long direction of the web, the spacing being the distance $D + d$ in the arrangement shown in FIG. 14. The patterns of the two rows are offset with respect to one another such that each pair of pins (separated by center-to-center pin spacing of D) is positioned opposite a gap having a center-to-center pin spacing of D + 2*d* on the other side, which positions the courses orthogonal to the long direction of the web. For diagonal laydown of patterns with true parallelism of adjacent courses, such as shown in FIG. 12, the appropriate positioning of pairs of pins on one side of the conveyor with respect to the pairs of pins on the other side is the same as the positioning employed for the corresponding orthogonal pattern, except that the pairs of pins on the right side are offset by angle $\alpha_L$ from the corresponding gap on the other side. In the preceding discussion the strand diameter has been treated as negligible. For more precise parallelism, and especially when the strand diameter is not negligible, the pin spacing should be arranged for equal spacing of the center points of the strands in adjacent courses.

In addition to pin spacing, factors controlling the laydown pattern for each strand include the directions in which the strand is traversed from left to right and from right to left, the direction of loop formation with respect to the direction of web laydown, and the speed of the conveyor with respect to the rate of strand deposition along the selvage. In setting up the apparatus to lay down a web pattern in which $\alpha_L = -\alpha_R$ (including $\alpha_L = \alpha_R = 0°$), the primary hooks are preferably mounted to rotate in the same plane on each side of the guide.

During each traverse of the strand a loop is formed which can be readily deposited around the strand-restraining elements, e.g., a pin or pins. The loop needs to be of sufficient width to span the targeted pins or other strand-restraining elements in their entirety so that deposition can be completed effectively, but should be only slightly wider than the maximum distance to be spanned; otherwise, strand deposition is jerky because the loop collapses under tension until it is restrained. The normal manner for forming loops is to form them in the direction away from the direction in which the completed web is moving, i.e., in the direction away from the course which has just been laid down. Forming the loops in this normal manner is a second requirement for laying down each course of the web truly parallel to the preceding course.

The conveyor carrying the rows of pins can be adjusted to operate at any desired speed. The rate of travel of the pins is thus independent of the rate at which loops are generated and laid down to form selvage segments. Accordingly, a third requirement for laying down each course truly parallel to the preceding course is that the distance traveled by the conveyor per unit of time be set equal to the total distance between courses of a single strand laid down per unit of time.

Figure 15:
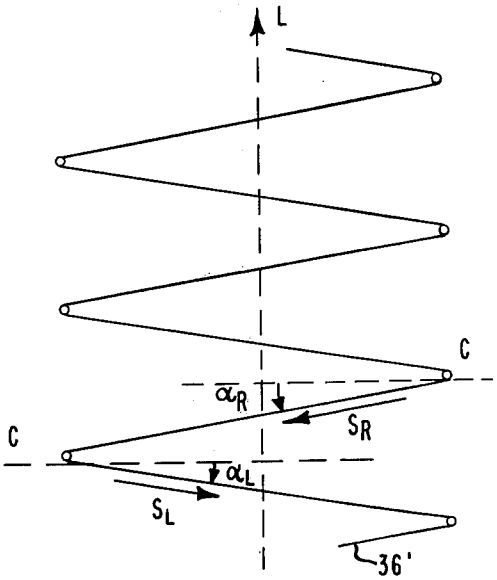
FIG. 15 shows a single-strand restrained web in which the courses of the web have V-shaped reversals at each side, only the alternate courses of the web being parallel.

In forming the pattern of FIG. 15, the pins are equally spaced along each row in staggered relationship to the pins on the opposite side of the conveyor. The strand is laid down during each traverse at an angle to L, in the direction away from the course which has just been laid down, but during each traverse only a small loop is formed, the size of the loop being suitable for deposition about a single pin. The conveyor is operated at a speed sufficient that adjacent courses are laid down at the desired angles $\alpha_L = \alpha_R$ of negative sign. In this laydown pattern the strand thus makes essentially a V-shaped reversal, the pin-contacting segments of the strand being in contact with almost half the circumference of each pin. This web pattern contains no selvage section of the strand parallel to the rows of pins between courses.

Figure 16:
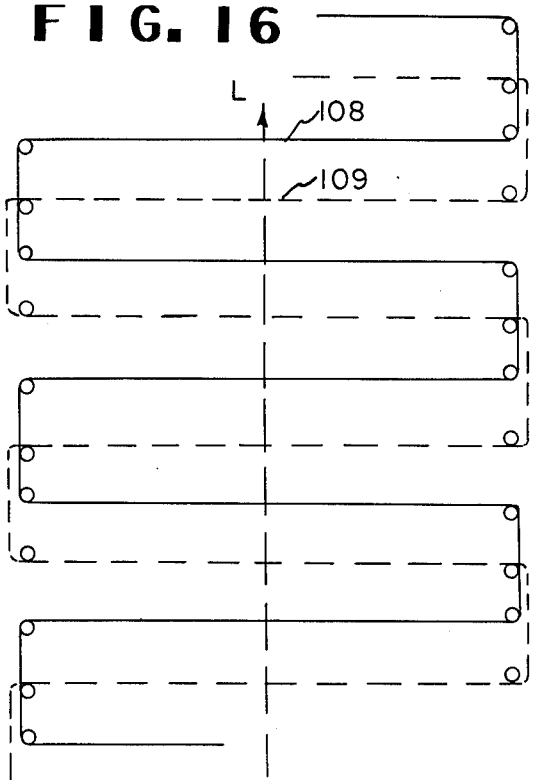
FIG. 16 shows a two-strand restrained web having a pattern in which all courses are parallel and are orthogonal to the long direction of the web.

FIG. 16 illustrates the web pattern obtained by traversing two strands, 108 (solid line) and 109 (line of dashes), in the manner shown in FIG. 4. To show the paths of each of the strands along the selvage more clearly, one of the strands is shown spaced away from the pins, although both of the strands are actually in contact with the pins around which they are traversed. In the restrained web so obtained, all courses are orthogonal to the long direction of the web. The loops formed during traverse span three pins (more generally, $n + 1$ pins are spanned by each loop when $n$ strands are traversed). For each strand the pins are spaced in a manner analogous to that shown in FIG. 14 (using a relatively large value for D), the pins for the other strand being inserted in each row in positions providing equal distances between the courses in the web. In this pattern $\alpha_F = \alpha_R = 0°$.

Figure 17:
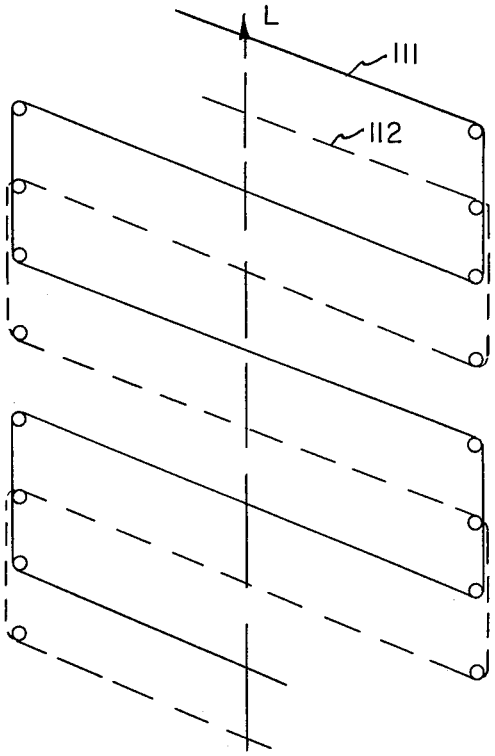
FIG. 17 shows a two-strand restrained web having a pattern in which all courses of the web are parallel and are diagonal to the long direction of the web.

FIG. 17 illustrates the web pattern obtained by traversing two strands 111, 112 in a manner analogous to that employed in FIG. 12 for a single strand. In the restrained web so obtained all courses are parallel to one another in the same diagonal direction between the two rows of pins. The loops formed during each traverse span three pins, only the first pin and the third pin being utilized for restraining any given strand. In this pattern $\alpha_L = -\alpha_R$.

Figure 18:
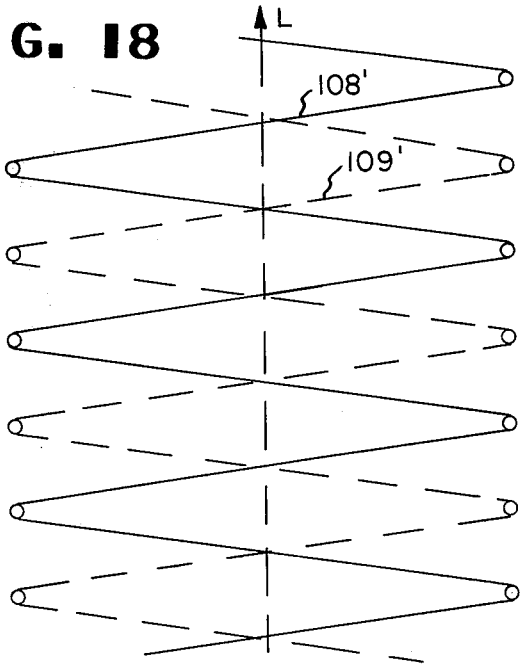
FIG. 18 shows a two-strand restrained web having diagonal courses with V-shaped reversals at each side of the web.

FIG. 18 illustrates the web pattern obtained by traversing two strands (108' and 109') in a manner analogous to that employed in FIG. 15 for a single strand. During each traverse of each strand a small loop is formed and deposited around a single pin. The two strands are traversed together, each being deposited at the end of each traverse around the second pin in the row from the last pin on the same side restraining the same strand. The web is characterized in appearance as an array of diamond-shaped patterns. In this pattern $\alpha_L = \alpha_R$ (both of negative sign).

Webs formed by the method and apparatus of this invention may be employed for any of the purposes described in the prior art for cross-laid webs.

In the apparatus of the invention the operations of traversing and depositing the strands are advantageously carried out with mechanical components which move in simple rotary paths. Web formation at strand feed speeds in excess of 1000 yards per minute is readily obtained.

Although four hooks and four spreaders are shown on the disks of FIG. 8 and five hooks and four spreaders on the disks of FIG. 4 other combinations of hooks and spreaders are possible. When more than one strand is traversed, it is preferred to have fewer spreaders than hooks. It is also preferred to engage the strand with a hook on one side prior to deposition of a loop on the other side of the conveyor.

What is claimed is:

1. An apparatus for traversing a strand between two spaced rows of strand-restraining elements moving together in the same direction at the same speed in the same plane to form a web, said apparatus comprising:

a strand supply source;

a guide located out of the plane of said rows and between them for receiving the strand from said supply source;

at least one pair of rotatable strand-engaging members associated with each row of strand-restraining elements for slideably engaging the strand between said guide and said plane and traversing said strand toward one and then the other row while forming a loop in said strand during each traverse and bringing said loop into a plane substantially parallel to the plane of the rows of strand-restraining elements and beyond said rows; and means for disengaging said loop from said strand-engaging members beyond said rows of strand-restraining elements and depositing the strand in a loop around at least one of said elements.

2. The apparatus of claim 1, each one of said pair being mounted for separate rotation on different centers and in different planes, said different planes being skewed with respect to each other.

3. The apparatus of claim 1, said guide being a bar with a plurality of eyelets therein, one of the pair of said strand-engaging members being a hook with slots therein, there being the same number of slots in each hook as eyelets in said bar.

4. The apparatus of claim 1, said means for disengaging said loop from said members being a blade located outboard of each row and synchronously rotated with respect to said strand-engaging members and said rows through a circular path extending above and below said rows.

5. A method for traversing a strand between two spaced rows of strand-restraining elements moving together in the same direction in the same plane to form a web, each traverse comprising:

feeding the strand from a supply to a location out of the plane of the rows of strand-restraining elements and between them, and thence toward one of the rows;

engaging the strand between said location and said strand-restraining elements and moving the strand toward the other row of strand-restraining elements in a transverse plane angled to the plane of the strand-restraining elements while simultaneously moving the strand away from said transverse plane to form a loop in the strand;

bringing said loop into a plane substantially parallel to the plane of the strand-restraining elements; and depositing said loop on said other row of strand-restraining elements.

6. The method as defined in claim 5, said transverse plane being orthogonal with respect to said rows.

7. The method as defined in claim 5, said transverse plane being diagonal with respect to said rows.

8. The method as defined in claim 5, said transverse plane being perpendicular to the plane in which the strand-restraining elements are moving.

9. The method as defined in claim 5, said strand being moved toward the other row of strand-restraining elements in an arcuate path.

10. In a method of traversing a strand between two spaced rows of strand-restraining elements moving together in the same direction in the same plane to form a web, wherein said strand is fed from a supply between the rows towards one row and is traversed in a plane transverse to the plane of the strand-restraining elements toward the other row, a loop being formed in the strand during each traverse;

the improvement comprising: turning the loop out of the plane of traverse into a plane substantially parallel to the plane of the strand-restraining elements; and then depositing it on said other row of strand-restraining elements.

* * * * *